US005170577A

United States Patent [19]

Brandolini et al.

[11] Patent Number: 5,170,577

[45] Date of Patent: Dec. 15, 1992

[54] ELECTRIC STEAM IRON COMPRISING A PLATE GROUPING TOGETHER THE REGULATING ELEMENTS

[75] Inventors: Jean-Louis Brandolini, St Etienne; Gilles Reguillon, St Maurice l'Exil, both of France

[73] Assignee: Seb S.A., France

[21] Appl. No.: 731,869

[22] Filed: Jul. 18, 1991

[30] Foreign Application Priority Data

Jul. 20, 1990 [FR] France ..... 90 09297

[51] Int. Cl.[5] ..... D06F 75/18

[52] U.S. Cl. ..... 38/77.8; 38/77.83; 219/245

[58] Field of Search ..... 38/77.3, 77.5–77.83, 38/81, 93, 94, 77.9; 219/245, 246, 248, 256

[56] References Cited

U.S. PATENT DOCUMENTS

| | | | |
|---|---|---|---|
| 2,179,259 | 11/1939 | Jones | 38/77.8 |
| 2,387,281 | 10/1945 | Morton | 38/77.7 |
| 2,520,360 | 8/1950 | Clark | 38/77.83 |
| 2,602,873 | 7/1952 | Finlayson | 219/248 X |
| 2,612,709 | 10/1952 | Dafforn et al. | 38/77.8 |
| 2,729,904 | 1/1956 | Maykemper | 38/77.83 X |
| 2,741,044 | 4/1956 | Maykemper | 38/77.5 |
| 2,918,739 | 12/1959 | Clearman | 38/77.5 |
| 3,130,507 | 4/1964 | Hoecker | 38/77.5 |
| 3,292,283 | 12/1966 | Hanner | 38/77.5 X |
| 3,413,741 | 12/1968 | Schwartz, Jr. et al. | 38/77.3 |
| 4,261,120 | 4/1981 | Greco et al. | 219/248 X |
| 4,535,556 | 8/1985 | Cavalli | 38/77.6 |
| 4,748,755 | 6/1988 | Bain, Jr. et al. | 38/88 |

FOREIGN PATENT DOCUMENTS

| | | | |
|---|---|---|---|
| 1542265 | 11/1967 | France | 38/77.83 |
| 2610764 | 1/1988 | France . | |
| 0018200 | 1/1985 | Japan | 219/247 |
| 2-080099 | 3/1990 | Japan | 38/77.7 |

*Primary Examiner*—Werner H. Schroeder
*Assistant Examiner*—Ismael Izaguirre
*Attorney, Agent, or Firm*—Finnegan, Henderson, Farabow, Garrett & Dunner

[57] ABSTRACT

An electric steam iron having a heating baseplate (1) and a vaporization chamber (2), and further including a plate (7) on which are fixed or formed at least part of the device (3) for feeding water to the vaporization chamber (2), an assembly (4) for regulating the flow of water and components for regulating the heating temperature and the electrical connections. The plate (7) and parts mounted thereon are preassembled and then assembled as a module into the iron.

17 Claims, 4 Drawing Sheets

ELECTRIC STEAM IRON COMPRISING A PLATE GROUPING TOGETHER THE REGULATING ELEMENTS

BACKGROUND OF THE INVENTION

1. Field of the Invention

The present invention relates to an improved electric steam iron.

2. Description of the Related Art

In all cases, a steam iron comprises a baseplate heated by means of an electrical resistor, a device for supplying water to the vaporization chamber which is located above the baseplate, and means for regulating the inlet flow of water into this chamber.

Known irons also comprise means such as a bimetallic-strip thermostat for regulating the heating temperature of the baseplate, electrical connections for connecting the mains to the heating resistor of the baseplate and electrical elements in order to regulate the temperature of the baseplate.

Known steam irons thus comprise a large number of different mechanical and electrical elements.

Given that all these elements each have an individual function, they are mounted inside the iron, one after the other, in any order.

Thus, the device for supplying water and regulating the flow of this water is mounted at a certain point in the iron, usually located at the front of the latter, the regulating button being located at the front of the handle of the iron.

Moreover, the thermostat is generally fixed close to the rear part of the iron, the button for regulating the temperature being located in the recess made underneath the handle of the iron.

The mounting of this thermostat requires several pieces to fix it to the iron, insulate certain of its parts and produce the electrical connections with the electrical heating resistor of the baseplate and the power cable.

In addition to the abovementioned elements, an electric iron also comprises a circuit breaker which comprises a fuse which is liable to melt in the event of the iron overheating, and an indicator light for monitoring operation of the iron.

Bearing in mind the large number of pieces to be manipulated, assembly of all these elements inside the iron is a long and thus costly operation.

SUMMARY OF THE INVENTION

The present invention aims to remedy the drawbacks of known embodiments by producing a steam iron which can be assembled under markedly more economical and reliable conditions.

The invention thus refers to an electric steam iron comprising a heating baseplate, a vaporization chamber, a device for feeding water to this chamber, means for regulating the inlet flow of water into this chamber, means for regulating the heating temperature of the baseplate, electrical connections for connecting the mains to the electrical resistor of the baseplate and to said means for regulating the temperature of this baseplate and, if appropriate, an indicator light.

According to the invention, this steam iron comprises a plate on which are fixed or are formed at least part of the device for feeding water to the vaporization chamber, the means for regulating the flow of water, and/or the means for regulating the heating temperature and the abovementioned electrical connections, said plate forming at least part of the structure of said device and/or of said means.

This plate thus forms a support which carries all or part of the mechanical elements for regulating the flow of the steam and/or the electrical elements for controlling the temperature.

A plate of this type pre-equipped with all these elements can be produced separately at the factory under very easy conditions, given that these elements are mounted on a common support. This pre-equipped plate is then easy to mount in the iron, for example by means of a few screws. Once this plate has been positioned in the iron, it suffices to make a few electrical or mechanical connections such as, for example, the link between the water reservoir and the water feed device, and the positioning of one or two control knobs.

According to an advantageous version of the invention, the plate is fixed above the vaporization chamber substantially parallel to the baseplate.

This position does not affect the height dimension of the iron and permits an easy link between the water feed device and the vaporization chamber.

According to a preferred version of the invention, the plate carries all of the water feed device and the device for regulating this flow of water, including the means for connecting the latter to the water reservoir of the iron and the vaporization chamber.

The plate preferably carries all of the means for regulating the temperature of the baseplate, including the electrical connections.

In the most advantageous version of the invention, the plate comprises all of the water feed device and the device for regulating the flow as well as all the means for regulating the temperature, including the attachment and connection means.

All the functional equipment of the iron is thus concentrated on this plate, which simplifies the construction of the iron and, above all, its assembly.

Other features and advantages of the invention will, in addition, become apparent from the following description.

BRIEF DESCRIPTION OF THE DRAWINGS

In the appended drawings, which are given by way of nonlimiting examples.

DETAILED DESCRIPTION OF THE PREFERRED EMBODIMENTS

Figure 1:
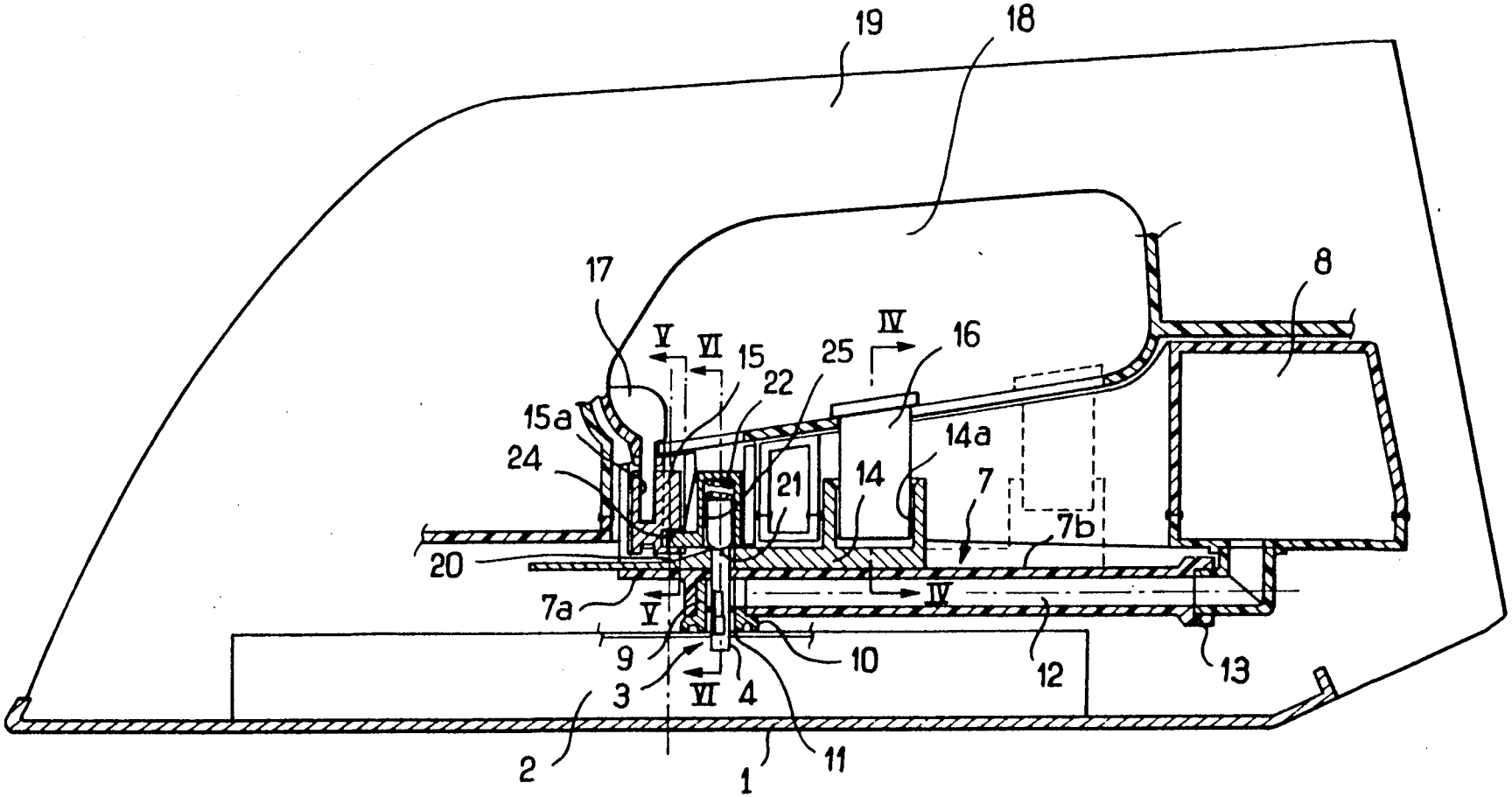
FIG. 1 is a diagrammatic view in longitudinal section of an iron according to the invention.
Figure 2:
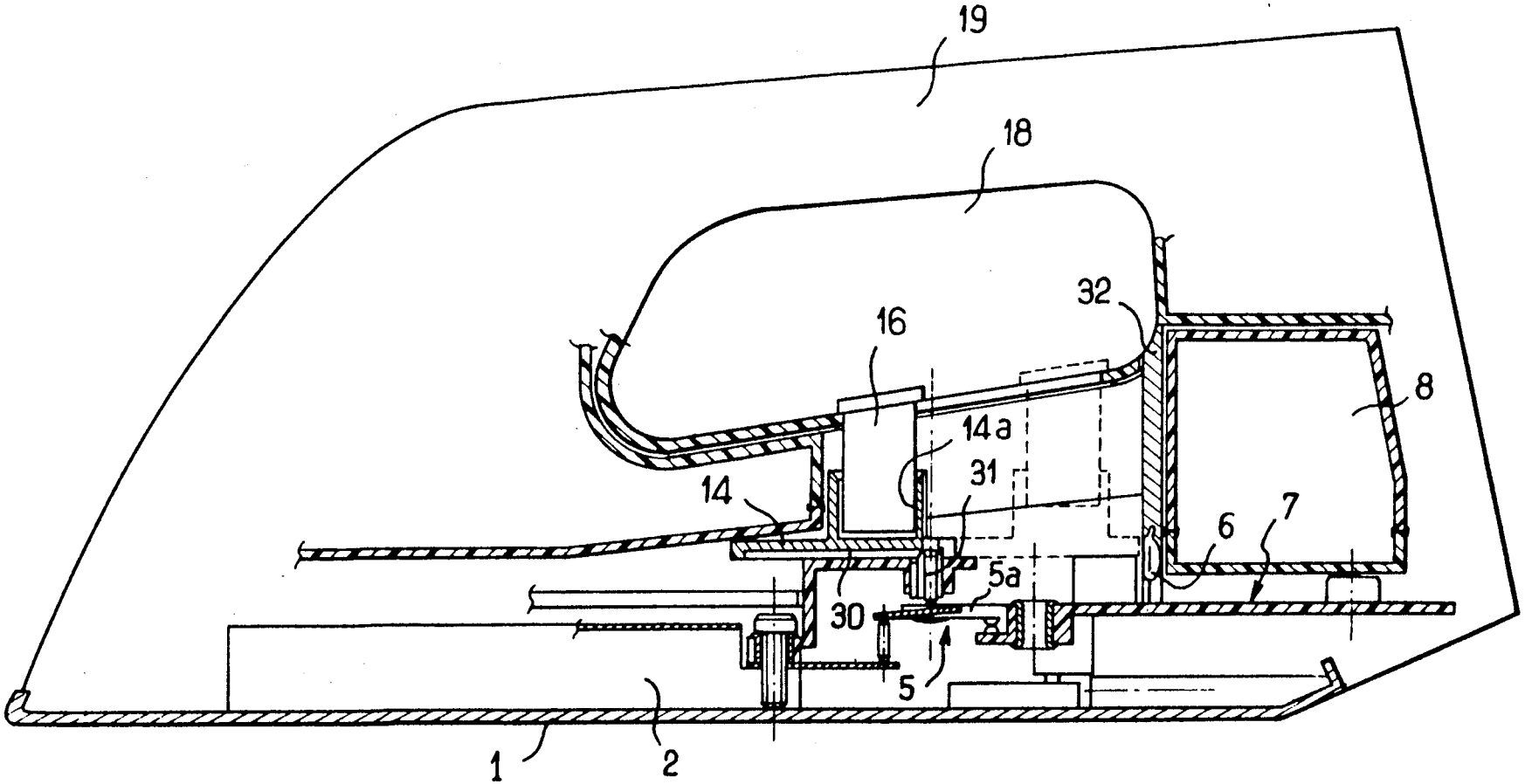
FIG. 2 is another view in longitudinal section parallel to the above view.

In the embodiment in FIGS. 1 and 2, the electric steam iron comprises a baseplate 1 heated by means of an electrical resistor (not shown), a vaporization chamber 2 located above the baseplate, a device 3 for feeding water to the chamber 2 and a pipe 4 for regulating the inlet flow of water to this chamber 2. The iron also comprises a thermostat 5 for regulating the heating temperature of the baseplate 1 and electrical connections for connecting the mains to the electrical resistor of the baseplate and to the thermostat 5 in order to regulate the temperature of this baseplate. Provision is also made for an indicator light 6 in order to show that the iron is operating.

The iron comprises a plate 7 on which are fixed or are formed at least part of the device 3 for feeding water to the vaporization chamber 2, including the pipe 4 for regulating the flow of water, and at least part of the means for regulating the heating temperature and the abovementioned electrical connections.

The plate 7 forming a support for the abovementioned elements is fixed above the vaporization chamber 2 and extends substantially parallel to the baseplate 1.

In the example shown in FIGS. 1 and 2, the plate 7 carries all of the device 3 for feeding water and for adjusting the flow of this water, including means (to be described below) for attachment of the latter to the water reservoir 8 of the iron and the vaporization chamber 2.

The plate 7 also carries all of the means for regulating the temperature of the baseplate 1, including the electrical connections.

More precisely, in the example shown, the plate 7 carries (see FIG. 1) on its face 7*a* adjacent the vaporization chamber 2 the body 9 of the device 3 for regulating the flow of water in which the pipe 4 in the form of a rod of said device is engaged. This body 9 carries at its end opposite the plate 7 a flexible seal 10 permitting a leaktight link with an opening 11 communicating with the vaporization chamber 2.

The face 7*a* of the plate 7 also comprises a water inlet conduit 12 molded with the plate 7 and opening out into the body 9. The end of this conduit 12 opposite the body 9 comprises a connector 13 linking with the base of the water reservoir 8.

The other face 7*b* of the plate carries mechanical elements 14, 15 for controlling the displacement of the pipe 4 in the body 9 and adjusting the flow of water, and the thermostat 5.

The elements 14, 15 are movable in translation relative to the plate 7 and comprise cavities 14*a*, 15*a* for fixing to the latter control knobs 16, 17 which are accessible to the user.

In the embodiment shown, the iron comprises, above the plate 7, a recess 18, made in the housing, forming the handle 19 of the iron. The knobs 16, 17 are fixed vertically in the cavities 14*a*, 15*a* of the elements 14, 15 and project into the recess 18. These control knobs 16, 17 are thus easily accessible to the users' fingers.

Figure 6:
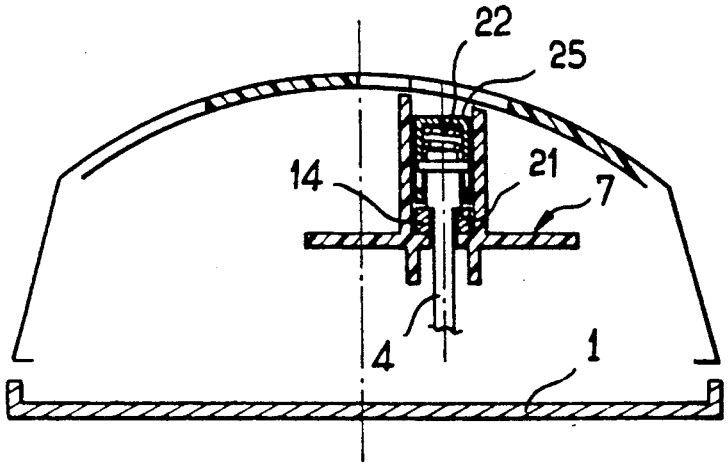
FIG. 6 is a sectional view according to the plane VI—VI in FIG. 1.

The first element 14 is mounted so as to slide on the plate 7 in the longitudinal direction of the iron. This element 14 comprises an inclined ramp 20 interacting with a bearing surface 21 (see FIGS. 1 and 6) of the pipe 4 in order to control the displacement of the latter in a direction perpendicular to the plate 7 against the action of a spring 22 pushing the pipe 4 towards the vaporization chamber 2. The user can thus regulate the flow of water into the vaporization chamber 2.

The second element 15 (see FIGS. 1 and 5) is mounted so as to slide on the plate 7 in a direction which is transverse to that of the first element 14. This element also comprises an inclined ramp 23 formed by a groove in which a finger 24 belonging to a part 25 integral with the pipe 4 is engaged. Thus, the displacement of the element 15 also controls the displacement of the pipe 4 in a direction perpendicular to the plate 7. The technical effects linked to the displacements of the elements 14 and 15 will be explained in detail during the description of the iron's operation.

Figure 3:
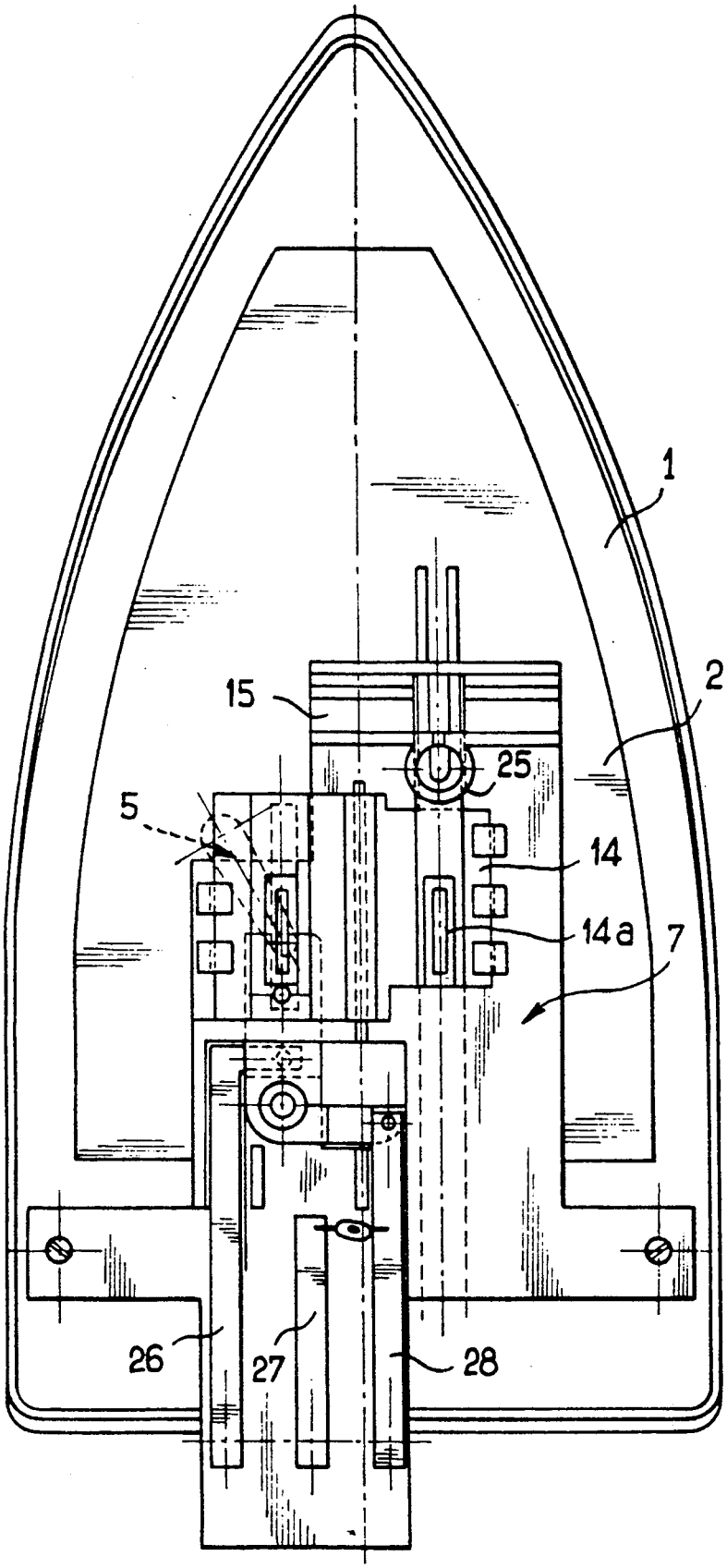
FIG. 3 is a plan view of the plate and of the heating baseplate, the housing of the iron and the control knobs of the elements carried by the plate having been removed.
Figure 4:
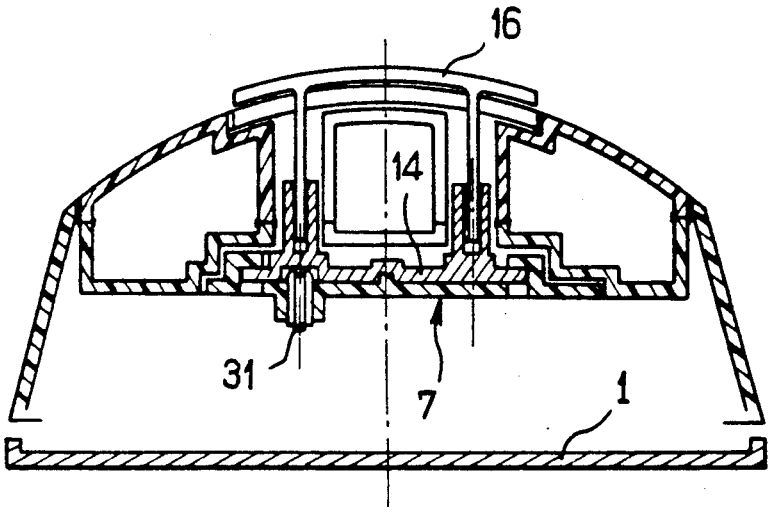
FIG. 4 is a sectional view according to the plane IV—IV in FIG. 1.

Moreover, the plate 7, made from an insulating plastic material, comprises on its face 7*b* (see FIG. 3) strip conductors 26, 27, 28 which are, for example, metallized. The ends 26*a*, 27*a* and 28*a* of these strips located at the rear of the iron are intended to be connected to the electrical power cable of the iron. The other ends of these strips are connected to the components of the thermostat 5 in order to regulate the . heating temperature of the baseplate and/or of the circuit breaker with a thermal fuse.

The thermostat 5 will not be described in detail here, since it is well known to a person skilled in the art. This is a conventional adjustable bimetallic-strip thermostat.

Similarly, the circuit breaker with a thermal fuse will not be described in detail. It may consist of a meltable material incorporated into the baseplate on which a rod which holds a switch in the closed position bears. In the event of an overload, the material melts and the rod sinks into this material, opening the switch.

Of course, the components of the thermostat 5 and/or of the circuit breaker are fixed on the face 7*a* of the plate 7 in a manner such that the latter acts as an electrically insulating support for these components.

In the example shown, the components of the thermostat 5 and/or those of the circuit breaker are fixed on the face 7*a* of the plate 7 opposite that carrying the elements 14, 15 for controlling the displacement of the pipe 4.

FIG. 2 also shows that the element 14 for controlling the displacement of the pipe 4 comprises means which interact with the regulating component 5*a* of the thermostat 5 in order to act on the latter upon displacement of said element 14.

To this end, the element 14 comprises on its face adjacent the plate 7 a surface 30 which is slightly inclined relative to the latter. This surface 30 interacts with a transmission rod 31 which passes through the plate 7 and bears on the regulating component 5*a* of the thermostat 5.

Moreover, the face 7*b* of the plate 7 carries an indicator light 6 which is visible in a zone 32 of the recess 18.

The operation of the device which has just been described will now be explained.

Upon displacement of the element 14 towards the right in FIG. 2, the rod 31 in contact with the component 5*a* of the thermostat and with the inclined surface 30 gradually sinks, pushing the component 5*a* of the thermostat 5 downwards. Thus, the displacement of the element 14*a* results in a modification of the setting of the thermostat 5 and thus in a modification of the temperature of the baseplate.

During the displacement operation of the element 14, the rod of the pipe 4 stressed by the spring descends due to the ramp 20, this resulting in a modification of the flow of the steam by virtue of the variable section of the well-known recess provided at the end of the pipe.

Thus, the displacement of the element 14 makes it possible simultaneously to modify the temperature of the baseplate and the flow of water and of steam.

Figure 5:
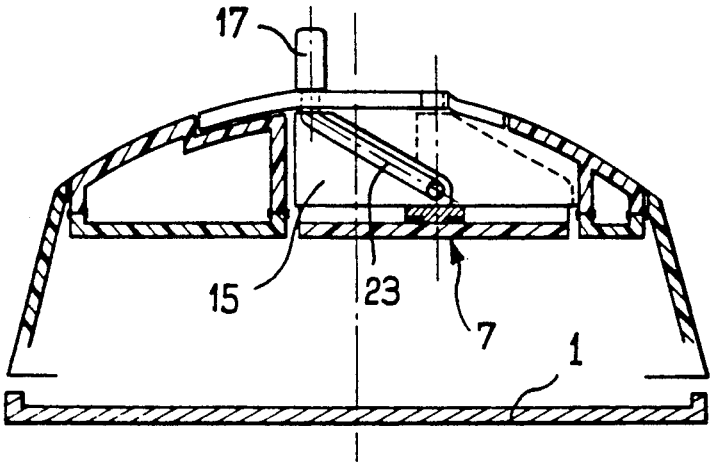
FIG. 5 is a sectional view according to the plane V—V in FIG. 1.

This opportunity exists only when the control knob 17 of the other element 15 is in the position shown in FIGS. 1 and 5.

In fact, it is only in this position that the surface 21 of the pipe 4 bears on the top of the element 14 and is thus capable of descending on the ramp.

By pushing the control knob 17 towards the right the finger 23 engaged in the ramp 20 rises along the latter, which causes a displacement of the pipe 4 upwards. During this displacement and according to the configuration of the recess made at the lower end of the pipe, the user can choose various regulating positions, such as the following:

automatic control position (that shown in FIGS. 1 and 5),
steam position,
double steam position,
dry position (no steam),
cleaning position.

The principal advantages of the invention are the following:

Given that the plate 7 supports and groups together all the elements for regulating the flow of water and the temperature, including the mechanical and electrical connection elements, the time for assembling the iron is considerably limited.

It suffices, in fact, to fix the plate 7 in the iron, for example by means of a few screws.

Moreover, given that the plate acts as a support for several elements, including some which are molded in a single piece with this plate, the number of pieces and thus the cost of the iron is reduced.

Moreover, the arrangement of these elements on a common plate makes it possible to produce a compact subassembly which reduces the size of the iron.

Of course, the invention is not restricted to the illustrative embodiment just described and several modifications may be made to it without departing from the scope of the invention.

Thus, the invention also covers those embodiments in which the plate groups together only the elements which serve to regulate the flow of water into the vaporization chamber or only the elements which serve to regulate the temperature of the heating plate.

We claim:

1. In an electric steam iron having a heating base plate (1), an electrical resistance heater for heating the base plate, a vaporizing chamber (2), conduit means (3) for feeding water to the chamber, regulating means (4) for controlling the flow of water into the chamber, conductor means (26, 27, 28) for supplying electricity to said resistance heater, and control means (5) for regulating the heating temperature of said heater, the improvement comprising: a single support plate (7) for carrying said conduit means, said regulating means, said conductor means and said control means in an operative position relative to said vaporizing chamber and said resistance heater, thereby to provide a directly insertable, self-contained module for ease of steam iron assembly.

2. The iron as claimed in claim 1, wherein the plate (7) is fixed above the vaporization chamber (2) substantially parallel to the baseplate (1).

3. The iron as claimed in claim 1, wherein the plate (7) carries the means (5) for regulating the temperature of the baseplate, including the electrical connections (26, 27, 28).

4. The iron as claimed in claim 1, wherein the plate (7) comprises the conduit means (3) for feeding water and the regulating means for controlling the inlet flow and the control means (5) for regulating the temperature, including mechanical attachment means and electrical connection means for the control means.

5. The iron as claimed in claim 1, wherein the plate (7) is made from an insulating material and comprises on one face thereon strip conductors (26, 27, 28), one end of said strips being connectable to the electrical power cable of the iron and the other end being connected to the control means (5) in order to regulate the heating temperature of the baseplate (1).

6. An electric steam iron comprising a housing and handle, a heated baseplate (1), a vaporization chamber (2), a device (3) for feeding water to said chamber, means (4) having a body (9) for regulating an inlet flow of water into said chamber, means (5) for regulating a heating temperature of the baseplate, electrical connections (26, 27, 28) for connecting an electrical power cable to an electrical resistor of the baseplate (1) and to said means for regulating the temperature of the baseplate, and an indicator light (6), wherein the iron comprises a plate (7) carrying at least part of the device (3) for feeding water to the vaporization chamber (2), the means (4) for regulating the flow of water, and the means (5) for regulating the temperature of the baseplate, including the electrical connections (26, 27, 28), wherein the plate (7) carries on a face adjacent the vaporization chamber (2) the body (9) of the means (3) for regulating the inlet flow of water, in which a pipe (4) in the form of a rod is engaged to said body (9), said body carrying at an end opposite the plate (7) a seal (10) providing a leaktight link with a communication opening (11) into the vaporization chamber (2).

7. The iron as claimed in claim 6, wherein said face of the plate (7) also comprises a water inlet conduit (12) opening into said body (9), another end of said conduit (12) opposite the body comprising a connector (13) for connecting said conduit with a water reservoir (8).

8. The iron as claimed in claim 6, wherein another face of the plate (7) has mechanical elements (14, 15) fixed thereto for providing a displacement of the pipe (4) in the body (9) in order to regulate the flow of water.

9. The iron as claimed in claim 8, wherein said elements (14, 15) are movable in translation relative to the plate (7) and comprise means for fixing control knobs (16, 17) to said elements which are accessible to the user.

10. The iron as claimed in claim 9, comprising, above the plate, a recess (18) made in the housing and forming the handle of the iron, wherein said knobs (16, 17) are fixed vertically to said elements (14, 15) and project into said recess (18).

11. The iron as claimed in claim 9, wherein the mechanical elements comprise a first element (14) mounted so as to slide on the plate (7) and comprising an inclined ramp (20) interacting with a bearing surface (21) of the pipe (4) in order to control the displacement of said first element in a direction perpendicular to the plate (7) against the action of a spring (22) pushing the pipe (4) downwards towards the vaporization chamber (2).

12. The iron as claimed in claim 11, wherein the mechanical elements comprise a second element (15) mounted so as to slide on the plate in a direction transverse to that of the first element (14) and comprising an inclined ramp (23) interacting with a finger (24), said finger comprises by a part (25) integral with the pipe (4) for controlling the displacement of the second element in a direction perpendicular to the plate (7).

13. The iron as claimed in claim 11, wherein a face of the plate (7) adjacent a recess (18) of the iron carries an indicator light (6).

14. An electric steam iron comprising a housing and handle, a heated baseplate (1), a vaporization chamber (2), a device (3) for feeding water to said chamber, means (4) having a body (9) for regulating an inlet flow of water into said chamber, means (5) for regulating a heating temperature of the baseplate, electrical connections (26, 27, 28) for connecting an electrical power cable to an electrical resistor of the baseplate (1) and to said means for regulating the temperature of the baseplate, and an indicator light (6), wherein the iron comprises a plate (7) carrying at least part of the device (3) for feeding water to the vaporization chamber (2), the means (4) for regulating the flow of water, and the means (5) for regulating the heating temperature and the electrical connections, said plate (7) being made from an insulating material and comprises on one face thereon strip conductors (26, 27, 28), one end of said strips connected to the electrical power cable of the iron and the other end being connected to a thermostat (5) having components to regulate the heating temperature of the baseplate (1), wherein components of the thermostat are fixed on one of the faces of the plate (7) so that the plate serves as an electrically insulating support for said components.

15. The iron as claimed in claim 14, wherein the components of the thermostat (5) are fixed on the face of the plate (7) opposite that comprising mechanical elements (14, 15) for controlling the displacement of the pipe (4).

16. The iron as claimed in claim 15, wherein one (14) of the mechanical elements for controlling the displacement of the pipe (4) comprises means interacting with a regulating component (**5*a*) of the thermostat (5**).

17. The iron as claimed in claim 16, wherein said one of the mechanical elements (14) comprises on a face adjacent the plate (7) a surface (30) which is slightly inclined relative to the plate, the surface (30) interacting with a transmission rod (31) passing through the plate (7) and in contact with the regulating component (**5*a*) of the thermostat (5**).

* * * * *